US005246313A

United States Patent [19]

Combet et al.

[11] Patent Number: 5,246,313

[45] Date of Patent: Sep. 21, 1993

[54] APPARATUS FOR FORMING LONG AND SHORT HOLES AND SETTING ROCK BOLTS

[75] Inventors: Michel Combet, Sathonay Camp; Alain Buisson, Lyons, both of France

[73] Assignee: Secoma S.A., Meyzieu, France

[21] Appl. No.: 723,489

[22] Filed: Jun. 28, 1991

[51] Int. Cl.[5] ..... E21D 20/00

[52] U.S. Cl. ..... 405/303; 405/259.1; 173/192; 173/36; 173/52

[58] Field of Search ..... 173/1, 192, 36, 52, 173/49; 405/303, 259.1; 175/209

[56] References Cited

U.S. PATENT DOCUMENTS

| | | | |
|---|---|---|---|
| 3,246,705 | 4/1966 | Chappuis | 173/44 |
| 3,965,997 | 6/1976 | Hilding et al. | 173/52 |
| 4,158,520 | 6/1979 | Prebensen | 405/259.1 |
| 4,497,378 | 2/1985 | Beney et al. | 173/52 |

FOREIGN PATENT DOCUMENTS

| | | | |
|---|---|---|---|
| 2228935 | 12/1974 | France . | |
| 2526479 | 11/1983 | France . | |
| 2545150 | 11/1984 | France . | |
| 0648898 | 4/1985 | Switzerland | 405/259.1 |

*Primary Examiner*—Hien H. Phan
*Assistant Examiner*—Allan M. Schrock
*Attorney, Agent, or Firm*—Herbert Dubno; Andrew Wilford

[57] ABSTRACT

An apparatus for drilling short and long holes and for fitting bolts to the short holes has a generally stationary support positioned adjacent the face and a turret angularly displaceable on the support between two end positions about a longitudinal turret axis. A drill slide longitudinally displaceable on the turret carries a drill having a rotatable stem centered on a drill axis parallel to the turret axis. A drill bit can be fitted to the stem. A bolt slide longitudinally displaceable on the turret adjacent the drill slide carries a bolting unit having a ram centered on a bolt axis. A magazine mounted on the support adjacent the turret has a plurality of seats adapted to hold the bolts and extension rods fittable between the bit and the drill stem, depending on whether the device is to be used for short-hold drilling and bolting or for long-hole drilling. A device on the support can transfer bolts from the magazine to the bolting unit when the turret is in the other end position for short-hole drilling and bolting and can transfer extension rods from the magazine to the drill in the one end position of the turret when the apparatus is used for long-hole drilling. A stinger on the turret is aligned on the drill axis with the drill stem and engageable with the drill bit and with a one of the extension rods engaged between the stem and the bit.

4 Claims, 4 Drawing Sheets

APPARATUS FOR FORMING LONG AND SHORT HOLES AND SETTING ROCK BOLTS

FIELD OF THE INVENTION

The present invention relates to a rock drill. More particularly this invention concerns an apparatus that can drill long and short holes in rock and that can even set bolts in the holes and a method of operating the apparatus.

BACKGROUND OF THE INVENTION

A standard rock-drilling and bolting machine such as described in U.S. Pat. Nos. 3,246,705, 4,497,378, and 4,473,325 can be used for short-hole drilling and subsequently fitting these holes with bolts or split sets. Such a machine has a jumbo or base on which is mounted a pivotal turret in turn carrying a drill and a bolt impactor. Once a hole has been made by the drill, the turret is pivoted to align the impactor with it so that a bolt can be rammed into the hole. Adjacent the turret is a carousel that has a pair of cradle plates that carry the bolts to be set, and a transfer device is provided for loading the impactor with bolts as same are needed. Such a device is used to stabilize a mine roof or even in some situations a side wall.

Another machine is known that is used for long-hole drilling. Such holes are used mainly for the installation of cable bolts that themselves are set in grout. Long holes are drilled by an altogether different drilling apparatus that is able to fit a succession of extension steels to the bit to drill a hole that is many times longer than the bit itself. The long holes are also usable for setting charges, taking cores, or just setting very long retaining rods. While the depth of a short hole is invariably less than the floor-to-roof height of the drift, a long hole is invariably a multiple of this dimension, so that the equipment for performing these different drilling functions is radically different. In a standard operation the short holes are less than 4 m in length while the long holes can be well in excess of 10 m.

This duplication of equipment represents a fairly large cost, in particular as each piece of equipment can cost a vast sum of money and since each such driller/-bolt setter must often work the very same area as the long-hole borer. Just getting the one piece of equipment out of the way for the other one to get in and work represents a significant amount of wasted time.

OBJECTS OF THE INVENTION

It is therefore an object of the present invention to provide an improved rock-drilling and bolt-setting apparatus.

Another object is the provision of such an improved rock-drilling and bolt-setting apparatus which overcomes the above-given disadvantages, that is which can drill short and long holes and that can also be used to set bolts in the short holes.

A further object is to provide an improved method of operating a boring and bolt-setting machine.

SUMMARY OF THE INVENTION

A drilling and bolting apparatus for drilling short and long holes at a location in a face and for fitting bolts to the short holes according to the invention has a generally stationary support positioned adjacent the face and a turret angularly displaceable on the support between two end positions about a longitudinal turret axis. A drill slide longitudinally displaceable on the turret carries a drill having a rotatable stem centered on a drill axis parallel to the turret axis and alignable longitudinally with the location in one of the end positions of the turret. A drill bit can be fitted to the stem. A bolt slide longitudinally displaceable on the turret adjacent the drill slide carries a bolting unit having a ram centered on a bolt axis parallel to the turret and drill axes and alignable longitudinally with the location in the other of the end positions of the turret. In accordance with the invention a magazine mounted on the support adjacent the turret has a plurality of seats adapted to hold the bolts and extension rods fittable between the bit and the drill stem, depending on whether the device is to be used for short hole drilling and bolting or for long-hole drilling. A device on the support can transfer bolts from the magazine to the bolting unit when the turret is in the other end position for short-hole drilling and bolting and can transfer extension rods from the magazine to the drill in the one end position of the turret when the apparatus is used for long-hole drilling. A stinger on the turret is aligned on the drill axis with the drill stem and engageable with the drill bit and with a one of the extension rods engaged between the stem and the bit.

With the system of the instant invention it is therefore possible to use the same complex hydraulic apparatus both for short-hole boring and subsequent fitting of the short holes with bolts, and for long-hole boring. The magazine is loaded with extension rods instead of bolts for the long-hole drilling. The long holes are typically fitted with cable bolts in a messy grouting operation that is best carried out with a wholly different piece of equipment in order to avoid getting concrete all over the delicate hydraulic parts of the apparatus. The stinger acts both as a guide and as a clamp. The clamping function is particularly interesting in long-hole boring in that it allows the rear end of the bit or previous extension rod to be held accurately in place while an extension rod is fitted to it or removed from it.

According to another feature of this invention the magazine is a rotatable carousel having a plurality of angularly spaced seats adapted to hold the bolts and extension rods. In addition the transfer means includes a pair of axially spaced grippers pivotal between a position engaged in the magazine and a position angularly offset therefrom and axially aligned with the location.

In accordance with yet another inventive feature the bolting unit is axially displaceable away from the face against an opposite face during drilling. This allows the apparatus to be solidly anchored in place between the floor and roof of a drift during a long-hole boring operation so that accidental misalignment is impossible.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
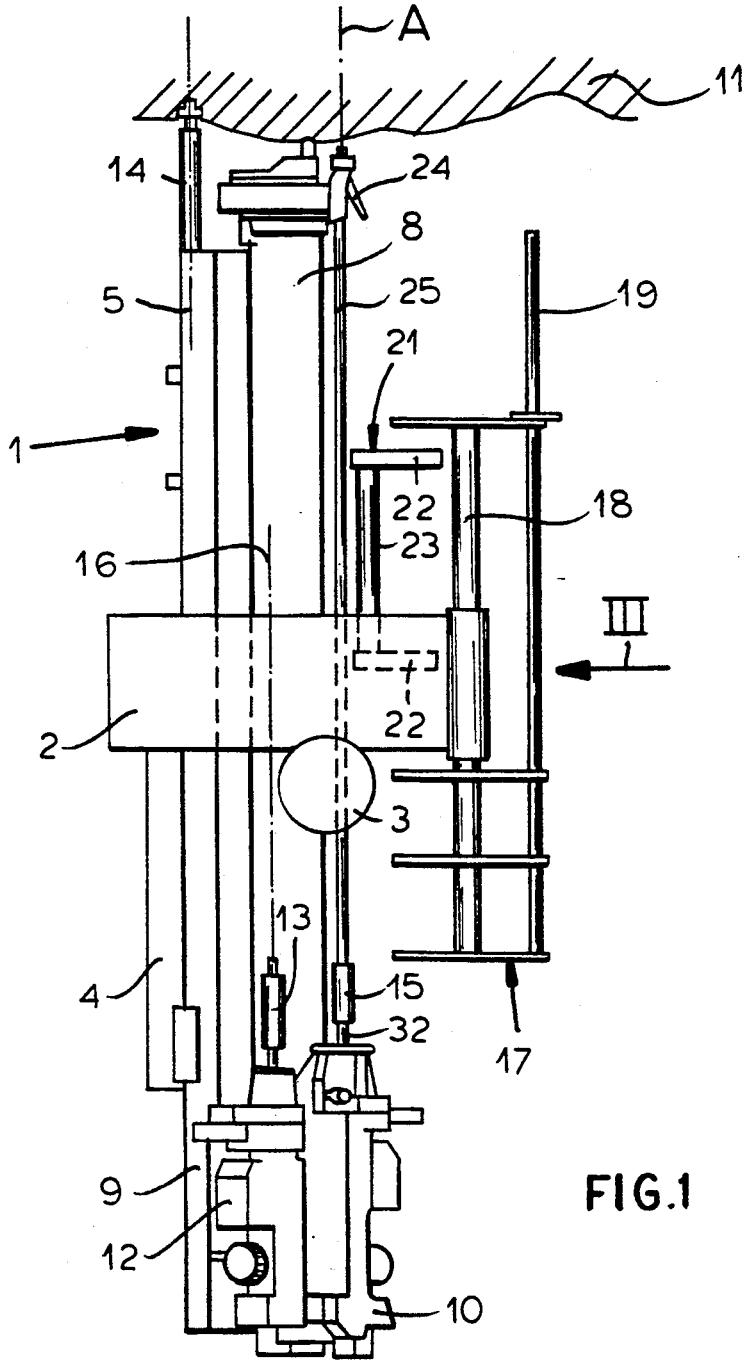
FIG. 1 is a side view of the apparatus of this invention set up for short-hole drilling and bolting.
Figure 2:
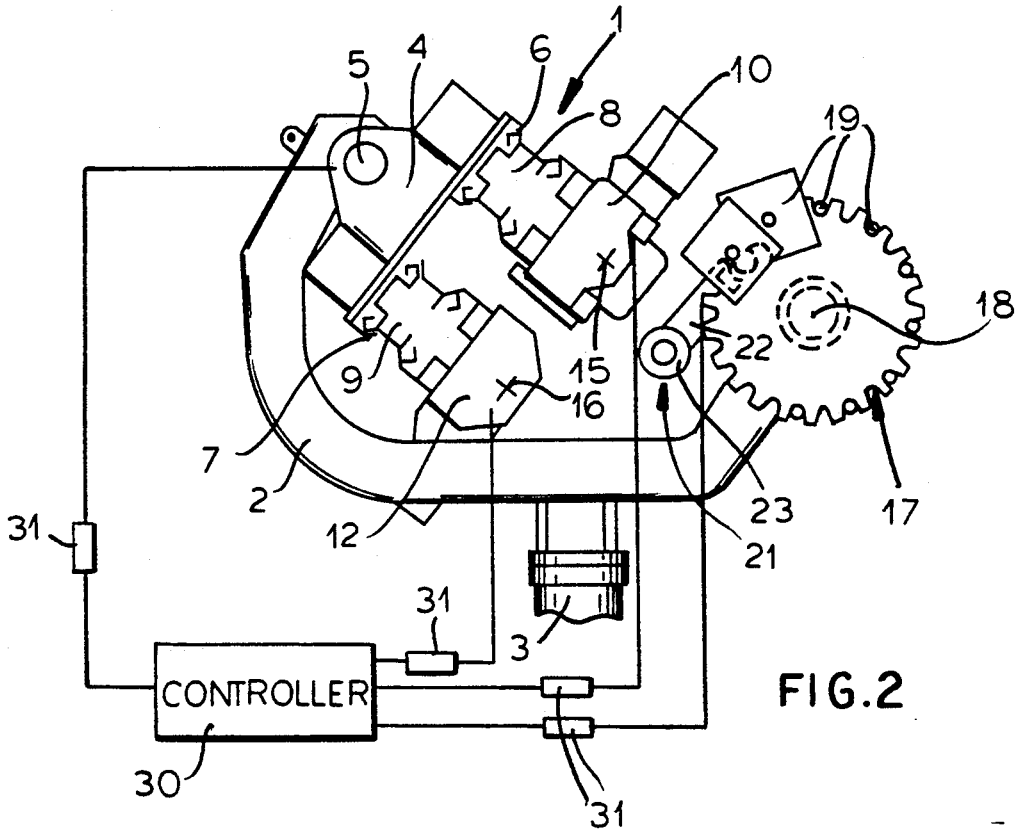
FIG. 2 is a partly diagrammatic top view of the apparatus as seen in FIG. 1.
Figure 4:
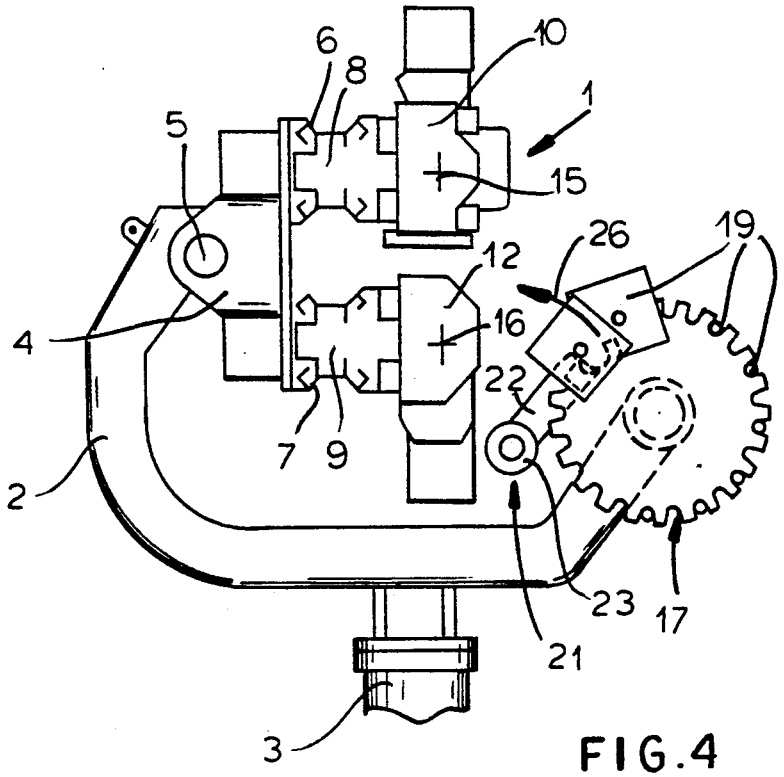
FIG. 4 is a view like FIG. 2 but with the apparatus set up for long-hole drilling.
Figure 3:
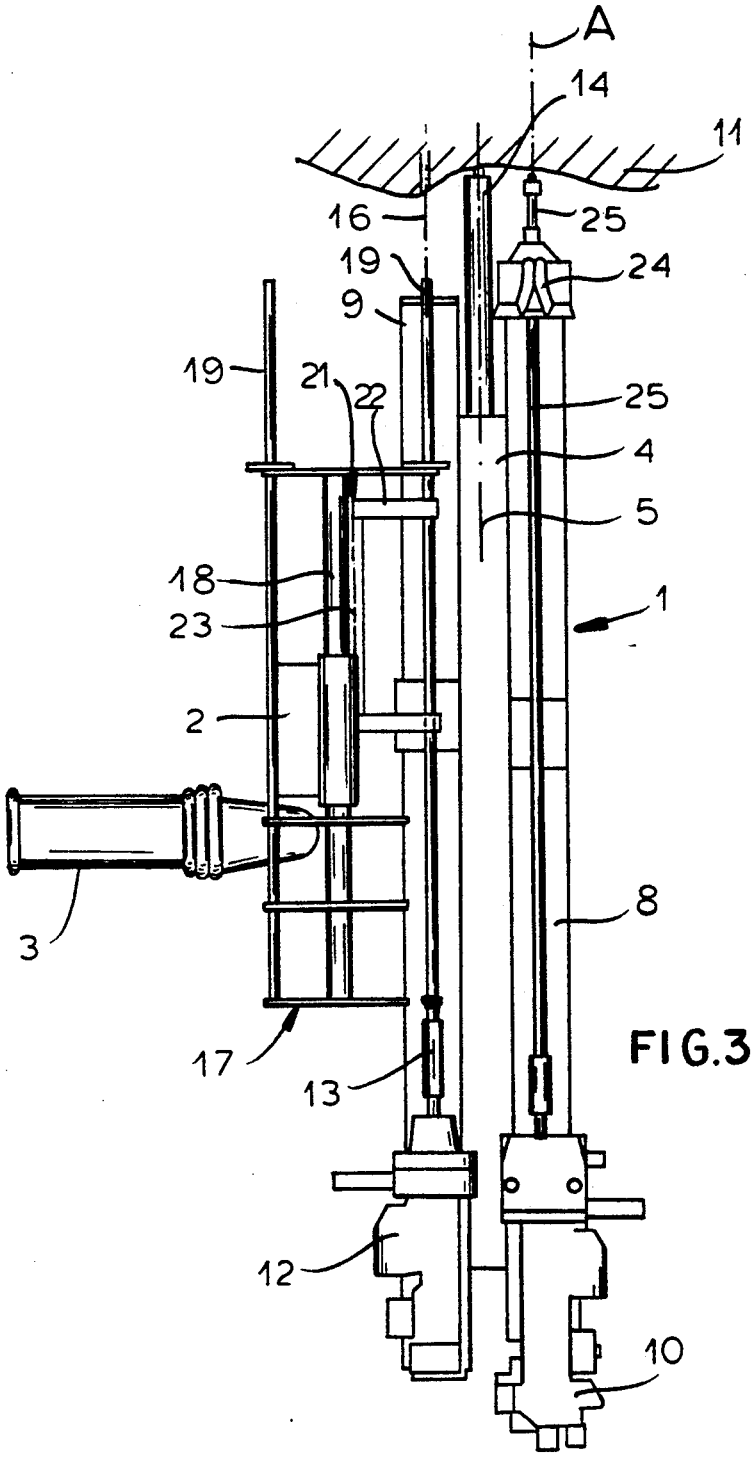
FIG. 3 is a side view of the apparatus taken in the direction of arrow III of FIG. 1.

As seen in FIGS. 1 through 3 an apparatus 1 according to this invention has a massive C-shaped support beam 2 carried on a partly illustrated mobile base or jumbo 3 and provided with a turret 4 that can pivot on one end of this beam 2 about a longitudinal axis 5 between the two angularly offset drilling and bolting positions shown in FIGS. 2 and 4, respectively. In the illustrated embodiment the longitudinal axis 5 is vertical. A pair of longitudinally extending rails 6 and 7 on the turret 4 carry respective longitudinally slidable and extending slides 8 and 9 for a drilling unit or drifter 10 and a bolt-impacting unit or drifter 12. These units 10 and 12 are movable with their slides 8 and 9 longitudinally parallel to the axis 5 and are centered on respective axes 15 and 16 that are parallel to and equispaced from the axis 5. It is therefore possible to align these axes 15 and 16 with a hole axis A on a rock face 11, here a ceiling, into which a hole is to be drilled and into which a bolt is to be set. In addition the beam 2 is provided with a face support 14 that can be pressed solidly against the face 11 adjacent the hole axis A to anchor the apparatus 1 solidly in place as it drills and sets a bolt.

A dual-plate carousel 17 is carried on the end of the beam 2 opposite the turret 4 and is rotatable about an axis 18 parallel via the axis 5. This carousel 17 acts as a magazine and has twenty-four peripheral seats in which are held rock bolts 19 that also extend parallel to the axis 5. A transfer device 21 comprising longitudinally spaced grippers 22 can pivot about an axis 23 parallel to the axis 5 to displace bolts 19 transversely from the respective cradle seats into alignment between a bolt-engaging chuck 13 of the impacting unit 12 at the axis 16 when same is aligned with the working hole axis A at which is provided a guide or stinger 24. The drill 10 itself has a stem 32 to which is fitted an elongated drill bit 25 on the axis 15.

A controller 30 is connected to hydraulic actuators such as shown schematically at 31 in FIG. 2 to the turret 4 to pivot it between its end positions, to the units 10 and 12 to move them along the axes 15 and 16, and to the transfer unit 21 to move it about its axis 23. This makes it possible to align the drill bit 25 with the axis A as seen in FIGS. 1, 2, and 3 and drill a hole along it and to thereafter pivot the turret 4 to align the chuck axis 16 as seen in FIG. 4 with the axis A, load a bolt 19 into the chuck 13, and thereafter drive this bolt 19 into the hole. In operation this entire sequence of steps can take place in at most 3 min for a 2.4 m long rock bolt or split set.

Figure 5:
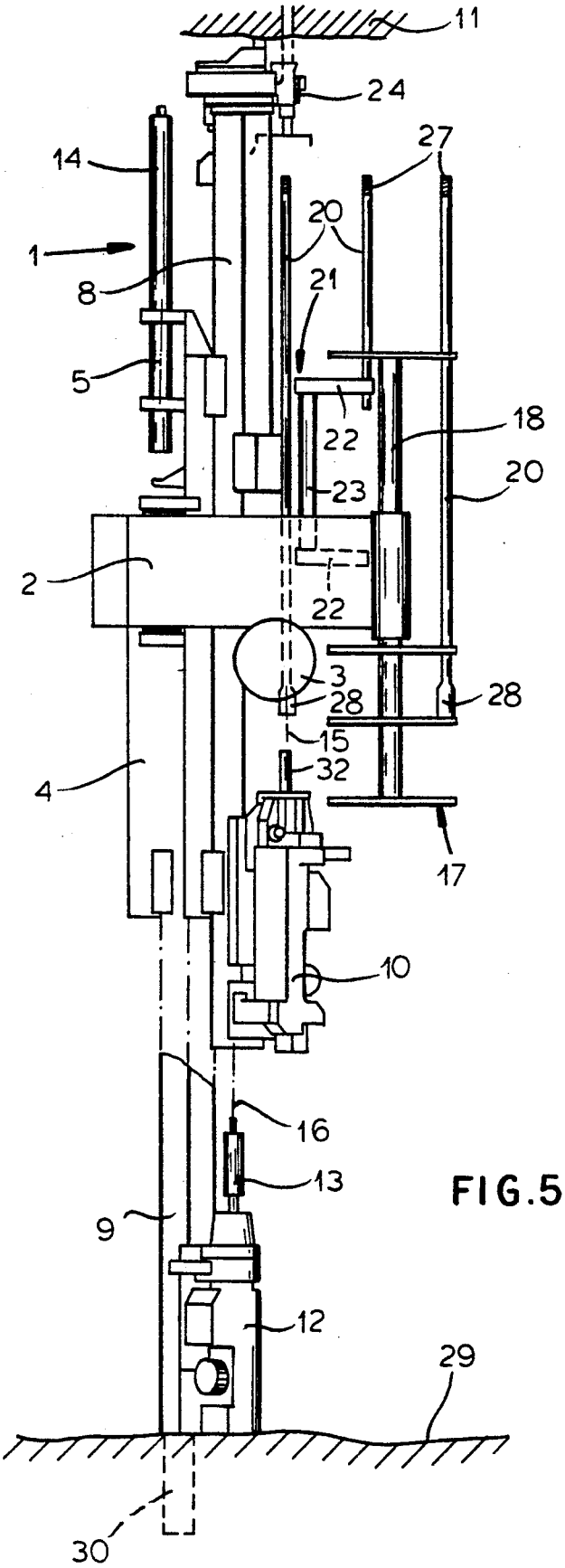
FIG. 5 is a side view like FIG. 1 but showing the apparatus set up for long-hole drilling.

In order to drill a long hole the carousel 17 is loaded not with rock bolts 19, but as shown in FIG. 5 with extension rods or steels 20 each having a male threaded front end 27 and a complimentary female threaded rear end 28. As seen in FIG. 5 for long-hole boring it is possible to further stabilize the equipment by pushing the drilling unit 12 back against a drift floor 29, thereby effective locking the whole apparatus 1 in place.

The long hole is drilled by first boring with the bit 25 until its rear end, which is internally threaded like the end 28 while the drill stem 32 is externally threaded like the end 27, is virtually flush with the stinger 24. This stinger 24 then grips the bit 25 and the drill 12 is reversed to separate it from the bit 25 and the drill 13 is backed by the respective actuator 31 sufficiently away from the bit 25 to allow an extension steel 20 to be swung by the transfer unit 21 into place aligned axially between the rear end of the bit 25 and the front end of the drill stem 32. The drill 12 is then advanced axially and rotated to screw its stem 32 into the back of the steel 20 and thereafter screw the front end of the steel 20 into the rear end of the bit 25, and then drilling can resume until the rear end 28 of the new extension rod is just behind the stinger 24, whereupon another extension can be added and so on. To retract the thus extended bit the drill 10 is retracted without rotation, then the next-to-last extension 20 is gripped and the drill 12 is reverse rotated to screw the last extension off the next-to-last one and off the drill spindle 32, thereby allowing the transfer device 21 to return it to the carousel 17, and this sequence is repeated until the extension rods 20 are all back in storage.

We claim:

1. A drilling and bolting apparatus for drilling short and long holes at a location in a face and for fitting bolts to the short holes, the apparatus comprising:

a generally stationary support positioned adjacent the face;

a turret angularly displaceable on the support between two end positions about a longitudinal turret axis;

a drill slide longitudinally displaceable on the turret;

a drill carried on the drill slide and having a rotatable stem centered on a drill axis parallel to the turret axis and alignable longitudinally with the location in one of the end positions of the turret;

a drill bit fittable to the stem;

a plurality of extension rods fittable between the bit and the drill stem;

a bolt slide longitudinally displaceable on the turret adjacent the drill slide;

a bolting unit carried on the bolt slide and having a ram centered on a bolt axis parallel to the turret and drill axes and alignable longitudinally with the location in the other of the end positions of the turret;

a magazine mounted on the support adjacent the turret and having a plurality of seats adapted to hold the bolts and the extension rods;

transfer means on the support for transferring bolts from the magazine to the bolting unit when the turret is in the other end position and for transferring extension rods from the magazine to the drill in the one end position of the turret; and a stinger on the turret aligned on the drill axis with the drill stem and engageable with the drill bit and with one of the extension rods engaged between the stem and the bit.

2. The drilling and bolting apparatus defined in claim 1 wherein the magazine is a rotatable carousel having a plurality of angularly spaced seats adapted to hold the bolts and extension rods.

3. The drilling and bolting apparatus defined in claim 2 wherein the transfer means includes a pair of axially spaced grippers pivotal between a position engaged in the magazine and a position angularly offset therefrom and axially aligned with the location.

4. The drilling and bolting apparatus defined in claim 1 wherein the bolting unit is axially displaceable away from the face against an opposite face during drilling.

* * * * *